US005941179A

United States Patent [19]

Herring

[11] Patent Number: 5,941,179

[45] Date of Patent: Aug. 24, 1999

[54] VARIABLE-CONFIGURATION PALLET OF MODULAR CONSTRUCTION

[75] Inventor: Morris A. Herring, Tucson, Ariz.

[73] Assignee: EcoPlastic Pallets, Inc., Tucson, Ariz.

[21] Appl. No.: 09/237,632

[22] Filed: Jan. 26, 1999

Related U.S. Application Data

[63] Continuation-in-part of application No. 29/081,165, Dec. 23, 1997, Pat. No. Des. 409,814.

[51] Int. Cl.[6] ..... B65D 19/38

[52] U.S. Cl. ..... 108/57.19; 108/56.3

[58] Field of Search ..... 108/51.11, 51.3, 108/56.3, 57.17, 57.19, 57.25, 57.33

[56] References Cited

U.S. PATENT DOCUMENTS

| | | | |
|---|---|---|---|
| 3,307,504 | 3/1967 | Cloyd et al. | 108/58 |
| 3,438,164 | 4/1969 | Duepree | 52/282 |
| 5,129,329 | 7/1992 | Clasen | 108/51.3 |
| 5,170,722 | 12/1992 | Friesner et al. | 108/56.1 |
| 5,365,859 | 11/1994 | Schrage | 108/56.1 |
| 5,402,735 | 4/1995 | Dejean | 108/51.1 |
| 5,417,167 | 5/1995 | Sadr | 108/51.1 |
| 5,456,189 | 10/1995 | Belle Isle | 108/51.1 |
| 5,458,069 | 10/1995 | Stolzman | 108/56.3 |
| 5,497,709 | 3/1996 | Gonzalez et al. | 108/56.3 |
| 5,546,872 | 8/1996 | Young | 108/56.1 |
| 5,579,701 | 12/1996 | Fook Wah | 108/51.1 |
| 5,601,035 | 2/1997 | Herring et al. | 108/51.3 |

FOREIGN PATENT DOCUMENTS

| | | | |
|---|---|---|---|
| 2026431 | 2/1980 | United Kingdom | 108/56.3 |

*Primary Examiner*—Peter M. Cuomo
*Assistant Examiner*—Jerry A. Anderson
*Attorney, Agent, or Firm*—Antonio R. Durando

[57] ABSTRACT

A pallet is assembled from three basic components that can be combined in various ways to produce different configurations. Several identical slats are connected in alternative positions to latches over the top member of at least two transverse runners, thereby forming a load-bearing support surface. The bottom side of each runner includes uniformly-spaced blocks for elevating the support surface over the ground and providing clearance under the top member for engagement of the pallet by the fork of material handling equipment. Identical slats are also connected to the bottom of these blocks to provide continuous bottom surfaces in the longitudinal direction of the pallet. An additional basic component, a foot-frame member that is adapted to fill the space between pairs of blocks in the underside of the runners, can be added or formed integrally with the runners to provide a continuous bottom surface also in the transverse direction of the pallet.

20 Claims, 15 Drawing Sheets

VARIABLE-CONFIGURATION PALLET OF MODULAR CONSTRUCTION

RELATED APPLICATIONS

This application is a continuation-in-part application of U.S. application Ser. No. 29/081,165, filed by the same inventor on Dec. 23, 1997, now U.S. Pat. No. Des. 409,814.

BACKGROUND OF THE INVENTION

1. Field of the Invention

This invention pertains to the general field of pallets for transporting loads. In particular, the invention relates to a three-component pallet of modular construction that can assume various forms to meet specific requirements of a user.

2. Description of the Prior Art

Pallets have been used for many years to provide a portable platform for handling, storing, or moving materials and packages, such as in warehouses, factories, or vehicles. Typically, the platform consists of multiple top slats mounted on transverse support elements that elevate the slats from the ground and allow handling of the pallet with forklift equipment. Bottom slats may also be used to reinforce the structure and/or provide a continuous surface for supporting the pallet on a conveyor.

Weight, cost, structural strength, versatility of use, ease of transport, and ability to re-use are all important factors in the evaluation of the ideal pallet for a particular application. Accordingly, the prior art is rich in designs developed for optimal performance for specific uses. U.S. Pat. No. 5,170,722, No. 5,365,859, No. 5,402,735, No. 5,456,189, No. 5,497,709, and No. 5,601,035 disclose various configurations of such prior-art pallets.

It would be desirable to have a pallet of modular construction that provided multiple configurations for different uses and that could be disassembled into basic components for ease of storage or transport and subsequent reassembly, as desired, into any one of the available alternative configurations. U.S. Pat. No. 5,417,167, issued to Sadr, provides much flexibility toward these goals by disclosing two components, a runner and a slat, that used in combination enable the modular assembly of various pallet configurations. The slats are connected to the runners by means of transverse grooves slidably coupled to a mating tongue running the length of the runners. Each slat has three such grooves to accommodate three runners. Thus, while the invention provides a modular system for mounting multiple slats at various points on the runners to provide different embodiments of a pallet, the number and position of the runners in the pallet is fixed, which limits the amount of support the pallet can provide. In addition, no configuration of the invention produces a continuous bottom surface in the transverse direction of the pallet, which is important for some applications. This invention is directed at fulfilling these needs.

BRIEF SUMMARY OF THE INVENTION

One of the objectives of this invention is a pallet of modular construction based on few basic components that can be used in different ways to assemble multiple configurations according to need.

Another objective of the invention is a pallet having interchangeable basic components that can be stored and/or transported separately after disassembly and then reassembled into an equivalent pallet prior to re-use.

Another goal of the invention is a pallet that can be strengthened by the judicious addition of more of the same basic components.

Another objective is a pallet that can be assembled with a variable number of longitudinal slats as well as transverse runners, so as to provide maximum flexibility in designing an optimal configuration for a specific task.

Still another goal of the invention is a pallet that can be adapted for transport on a continuous conveyor by providing continuous bottom surfaces in the direction transverse to the pallet.

Yet another goal is a pallet suitable for manufacture in a variety of materials, so as to optimize the tradeoff between cost, durability and ruggedness.

Finally, a further goal of the invention is the realization of the above mentioned objectives in an economical and commercially viable manner.

To the accomplishment of these and other objectives, the invention consists of a pallet assembled from three basic components that can be combined in various ways to produce different configurations. Several identical slats are connected in alternative positions to latches over the top member of at least two transverse runners, thereby forming a load-bearing support surface. The bottom side of each runner includes uniformly-spaced blocks for elevating the support surface over the ground and providing clearance under the top member for engagement of the pallet by the fork of material handling equipment. Identical slats are also connected to the bottom of these blocks to provide continuous bottom surfaces in the longitudinal direction of the pallet. Because of the design of the means of attachment of the slats to the runners, each slat can be connected at multiple points along the length of the runners, and each runner can be connected at any point along the length of the slats. An additional basic component, a foot-frame member that is adapted to fill the space between pairs of blocks in the underside of the runners, can be added or formed integrally with the runners to provide a continuous bottom surface also in the transverse direction of the pallet.

By providing multiple alternative locations for attachment of the top slats over the runners and by using a variable number of slats and runners, several different pallet configurations can be assembled, each designed to best fulfill a particular need. After use, the pallet can be disassembled into its basic components for ease of storage and/or transport. The components can be subsequently reassembled into the same or a different type of pallet, as needed.

Various other purposes and advantages of this invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only one of the various ways in which the invention may be practiced.

DETAILED DESCRIPTION OF THE INVENTION

The inventive aspects of the pallet described herein lie in the specific structural configuration of its modular basic components, which makes it possible to achieve ease of storage and portability, and to implement various configurations particularly adapted for specific uses. The prior art discloses modular pallets and various configurations designed to provide particular features, but no single pallet exists that provides the versatility and advantages of the present invention.

Figure 1:
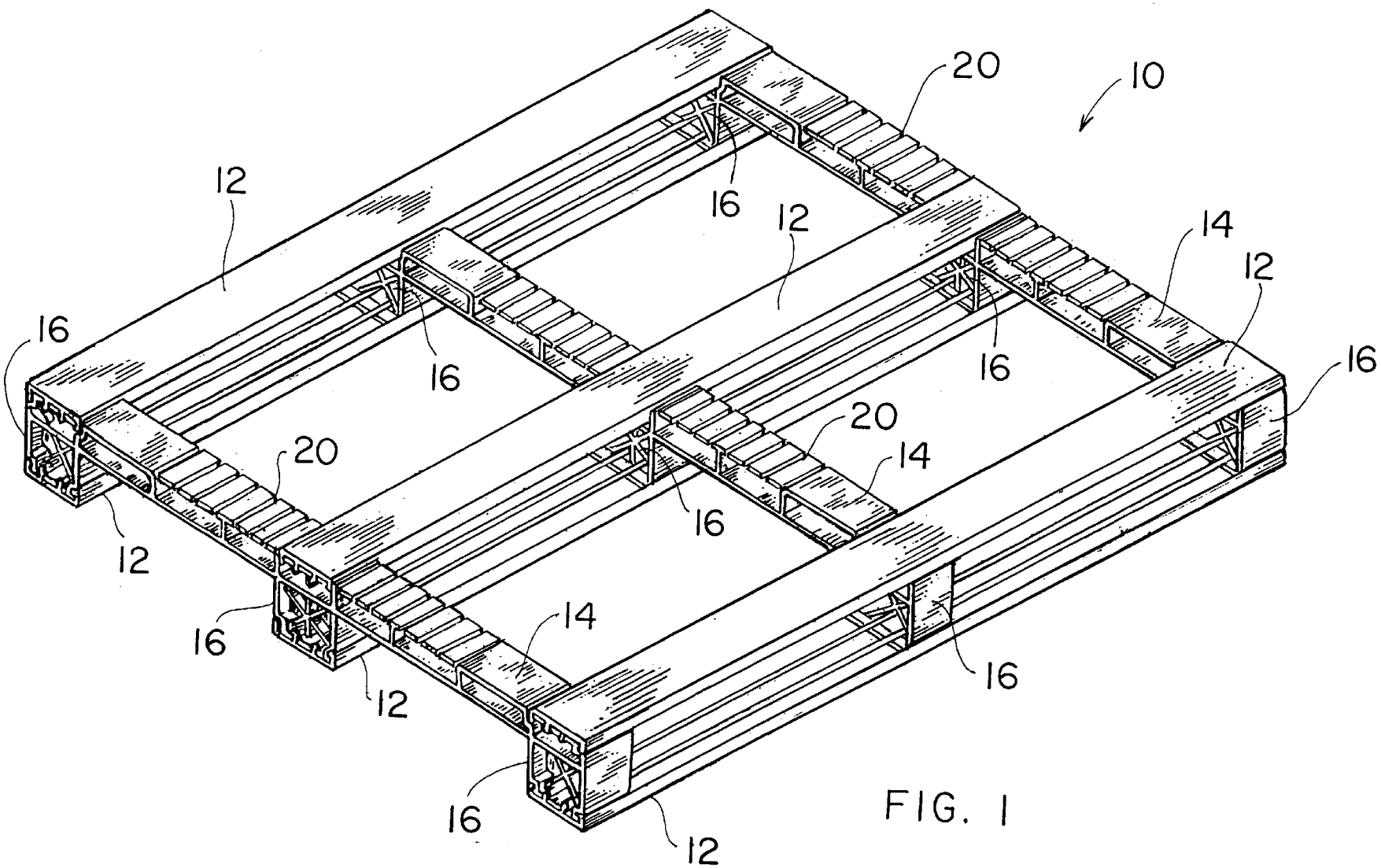
FIG. 1 is a perspective view of a pallet of modular construction according to the present invention.
Figure 2:
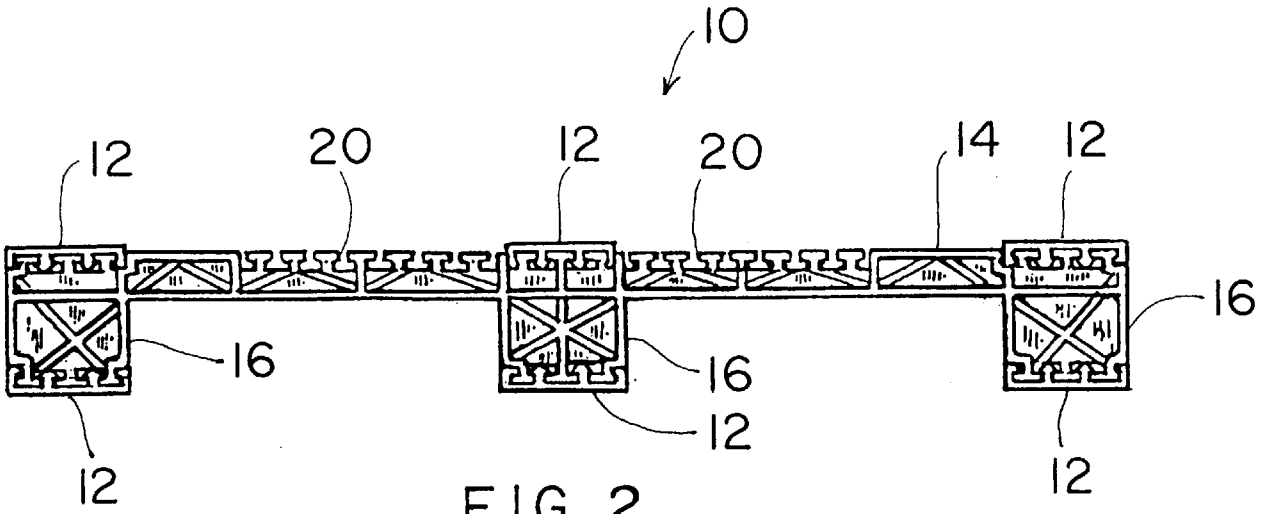
FIG. 2 is a front elevational view of the pallet of FIG. 1.
Figure 3:
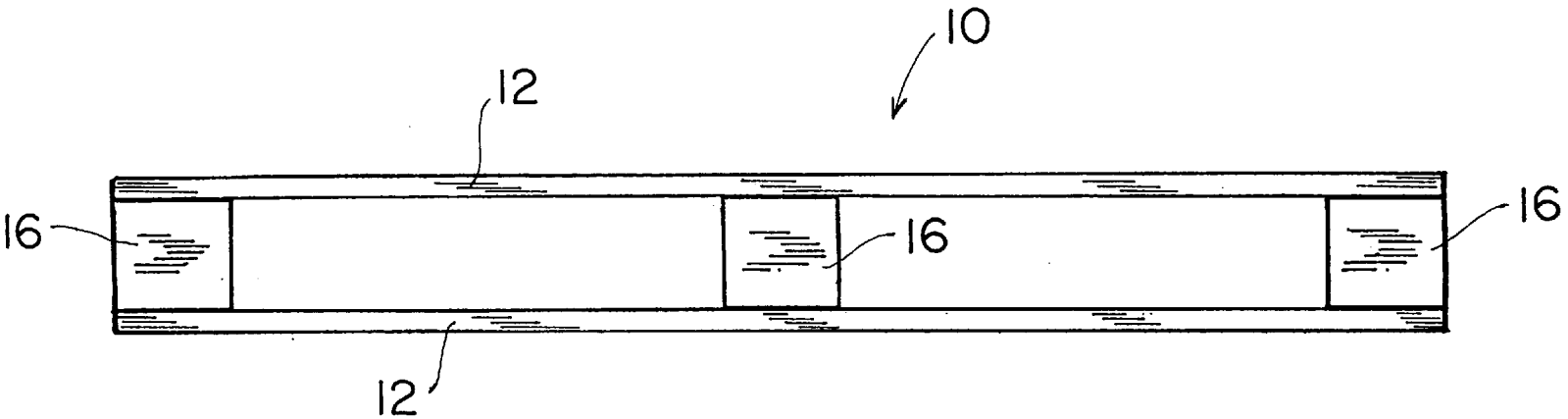
FIG. 3 is a side elevational view of the pallet of FIG. 1.

Referring to the drawings, wherein like parts are referenced throughout with the same numerals and symbols, FIG. 1 shows a perspective view of a pallet 10 assembled according to the invention. The pallet 10 comprises three slats 12 assembled substantially equidistantly over three transverse runners 14 to form a load bearing platform. As in the case of all conventional pallets, the three slats 12 are disposed in parallel along the longitudinal axis of the pallet 10 and the three runners 14 are placed transversely to the slats, also uniformly spaced for better distribution of the load borne by the pallet. Each runner 14 includes three integral blocks 16, preferably uniformly spaced, that provide elevation to the support surface of the pallet and define windows for inserting the fork of a forklift for handling the pallet and its load. As seen in the front and side elevational views of FIGS. 2 and 3, three slats 12 are also connected to the bottom sides of the blocks 16 to form continuous longitudinal support rails that provide strength and stability to the pallet.

As used in this disclosure, a runner is defined as an elongated support member disposed transversely in the pallet and having a top load-bearing surface and at least two bottom blocks that provide bottom support surfaces and define openings for engagement by a forklift. A slat is defined as a board-like elongated structure disposed longitudinally in the pallet. Some slats are used to form the top platform of the pallet and others to form continuous support rails at the bottom of the pallet.

Figure 4:
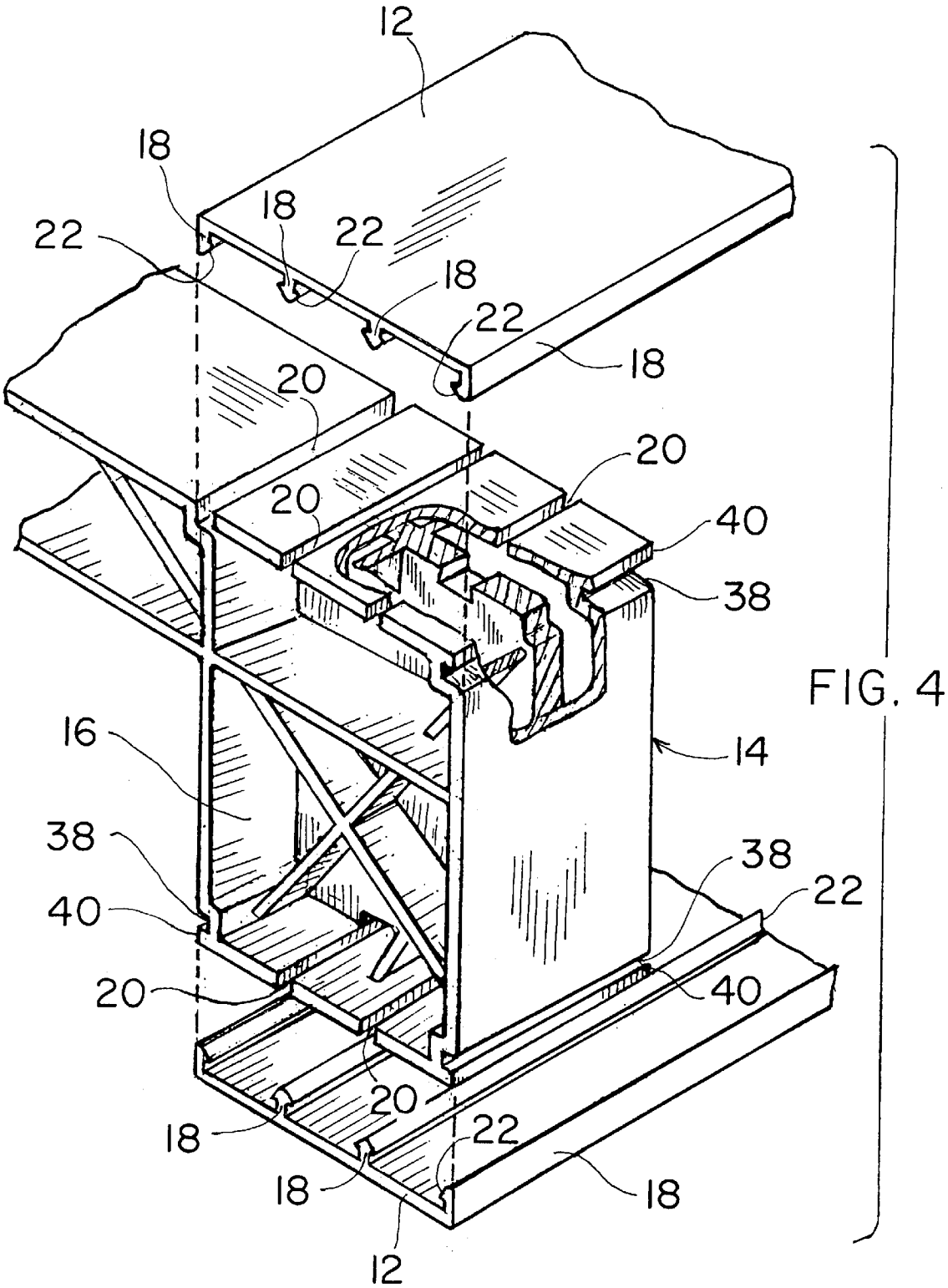
FIG. 4 is an enlarged, partially cut-out perspective view of the end block of a runner and of interlocking top and bottom slats to illustrate the structural details of the snap-on latch mechanism used to connects the slats to the runners of the invention.
Figure 12:
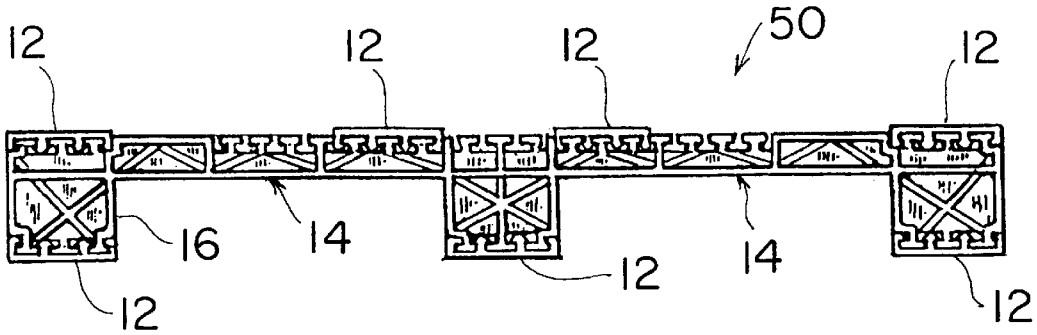
FIG. 12 is an elevational view of the front side of the pallet of FIG. 11.
Figure 5:
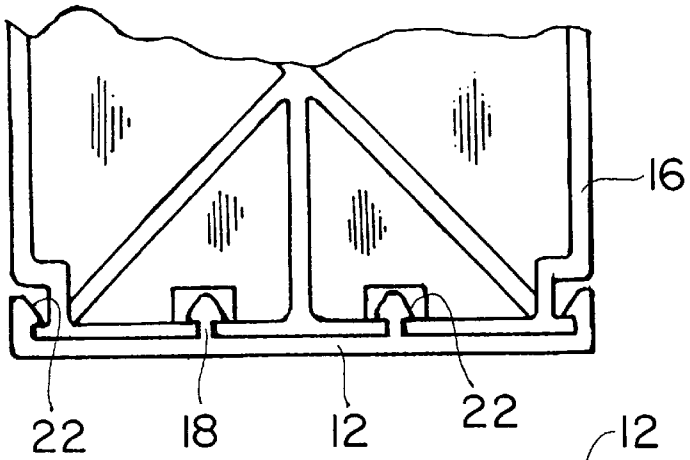
FIG. 5 is an enlarged, partial front elevational view of the central block of a runner showing clasping slots interlocking with the fastening ridges of a bottom slat.
Figure 7:
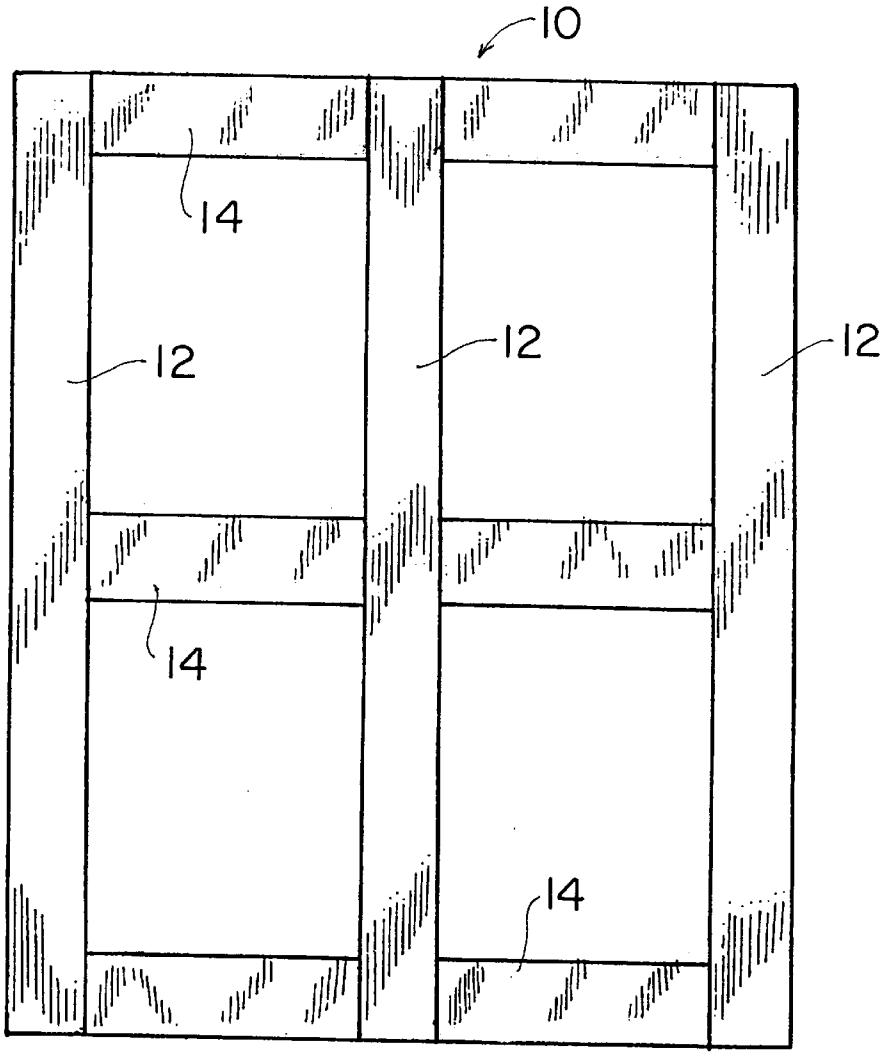
FIG. 7 is a bottom plan view of the pallet of FIG. 1.
Figure 6:
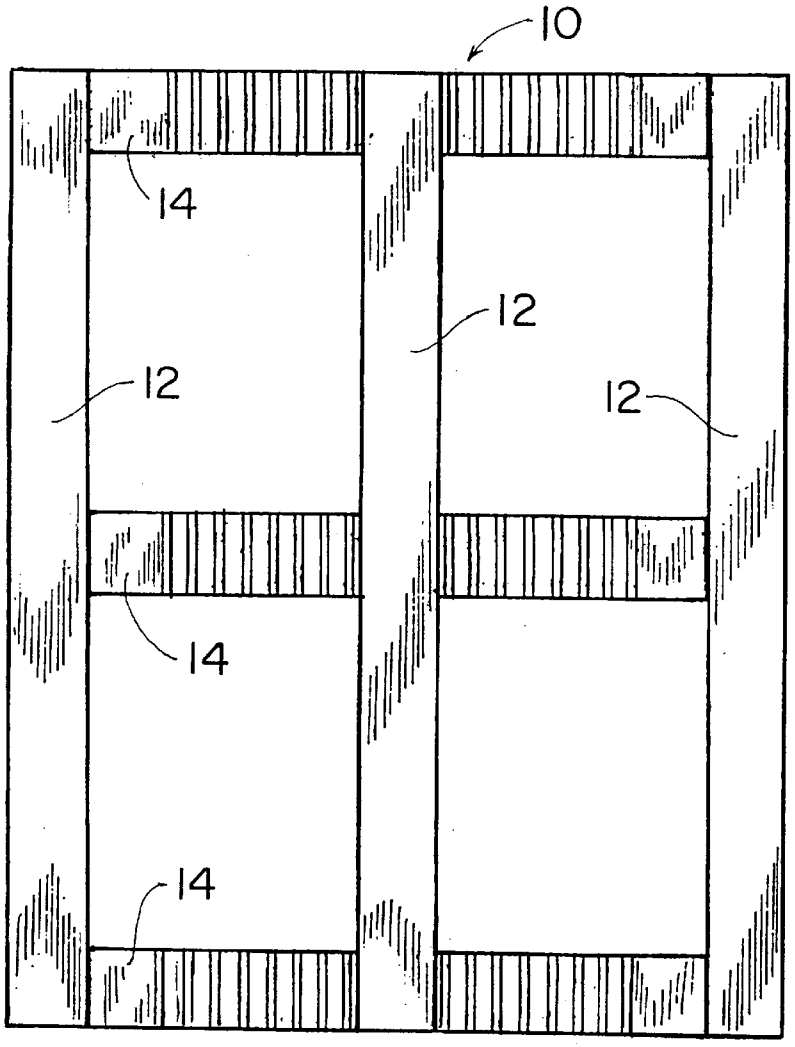
FIG. 6 is a top plan view of the pallet of FIG. 1.

The various parts of the invention are attached by snap-on interconnecting latches that are press fitted to assemble the pallet, as illustrated in the enlarged partial view of FIG. 4. It is noted that the connection could be make as well by engaging the latches in male-female fashion and sliding the parts in place. Each slat 12 includes longitudinal fastening ridges 18 adapted to mate with corresponding clasping slots 20 formed in the top and bottom surfaces of the runners 14. The fastening ridges 18 contain lateral lips 22 adapted for latching onto the top and bottom of the runner 12 after insertion of the ridges into clasping slots 20, as more clearly visible in the end view of FIG. 5. The lips 22 and slots 20 are sized for slidable or snap-on, releasable interlocking connection based on the resilience of the material according to conventional latching-mechanism technology. The resulting structure consists of the combination of multiple units of only two basic components, the slats 12 and the runners 14, held together by a plurality of such connecting latches. As also shown in the top and bottom views of FIGS. 6 and 7, the pallet 10 comprises a total of six slats 12 and three runners 14 assembled as described. The pallet can be easily disassembled by pulling the components apart for storage or shipping.

Figure 8:
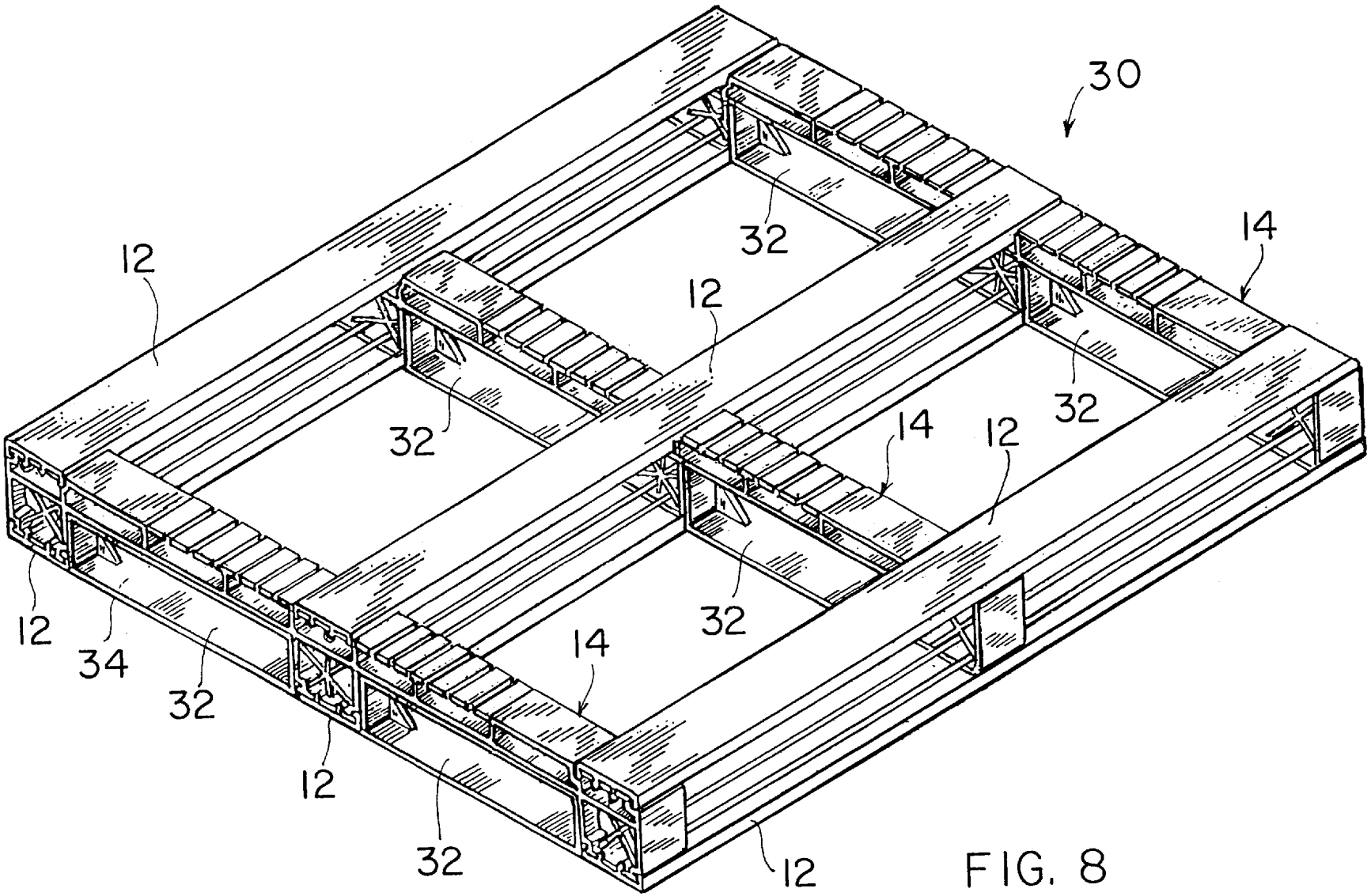
FIG. 8 is a perspective view of another embodiment of the pallet of FIG. 1 which further includes modular foot frames forming continuous transverse supports on the bottom side of the pallet.
Figure 10:
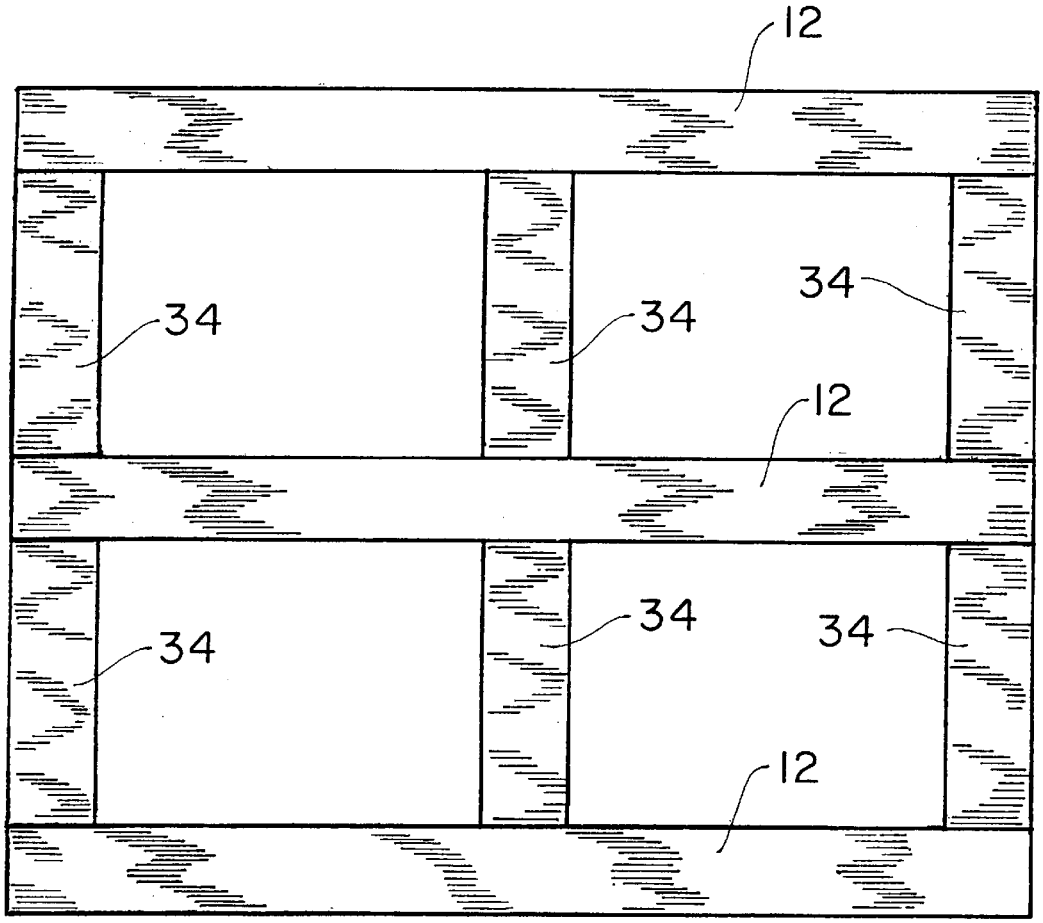
FIG. 10 is a bottom plan view of the pallet of FIG. 6, showing the continuous bottom rails formed by the addition of foot frames.
Figure 9:
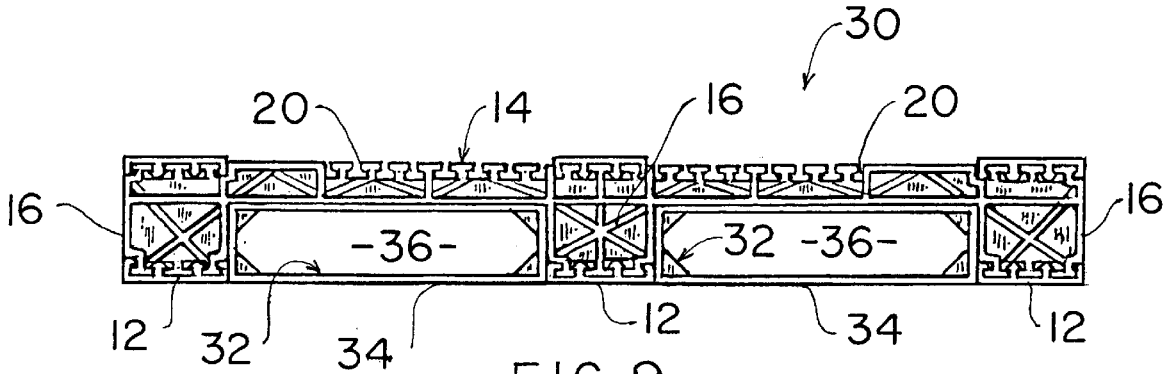
FIG. 9 is an elevational view of the front side of the pallet of FIG. 6.
Figure 11:
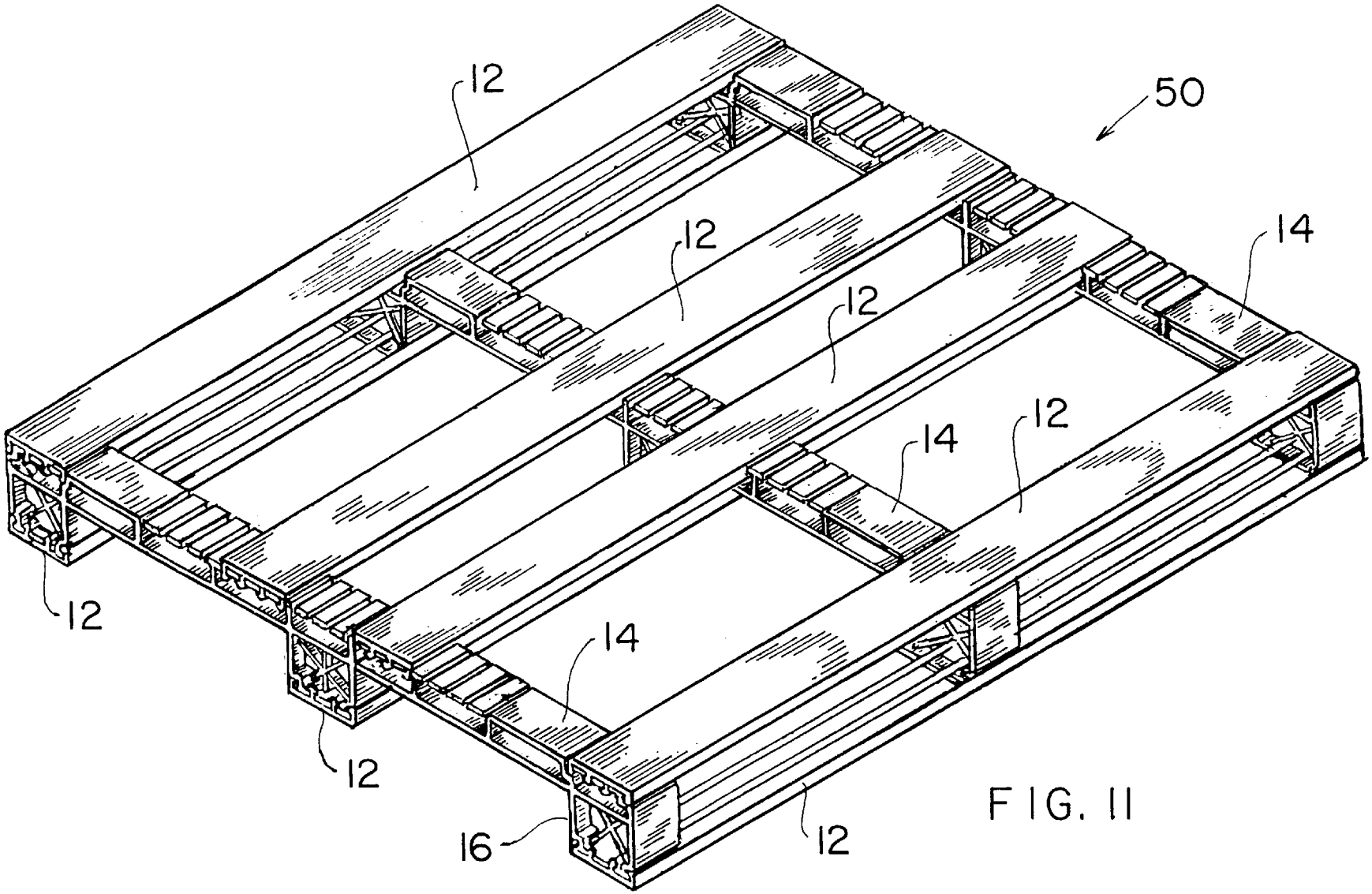
FIG. 11 is a perspective view of a four top-slat embodiment of a pallet according to the invention.
Figure 14:
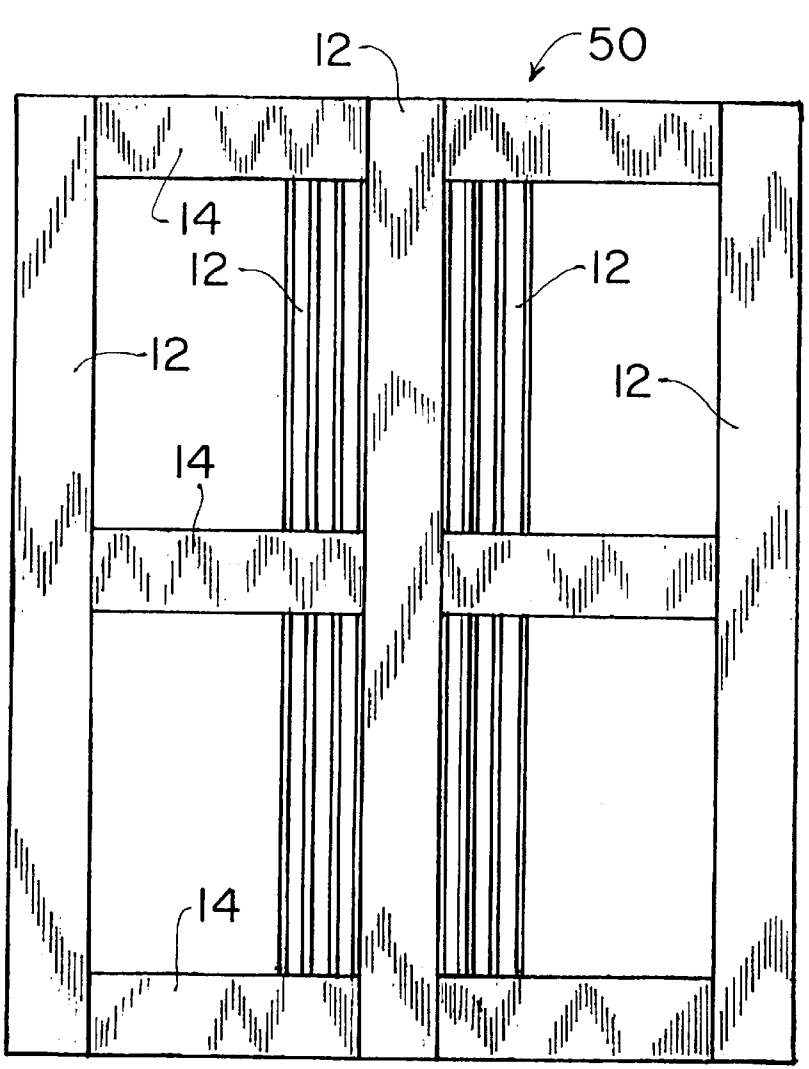
FIG. 14 is a bottom plan view of the pallet of FIG. 11.
Figure 13:
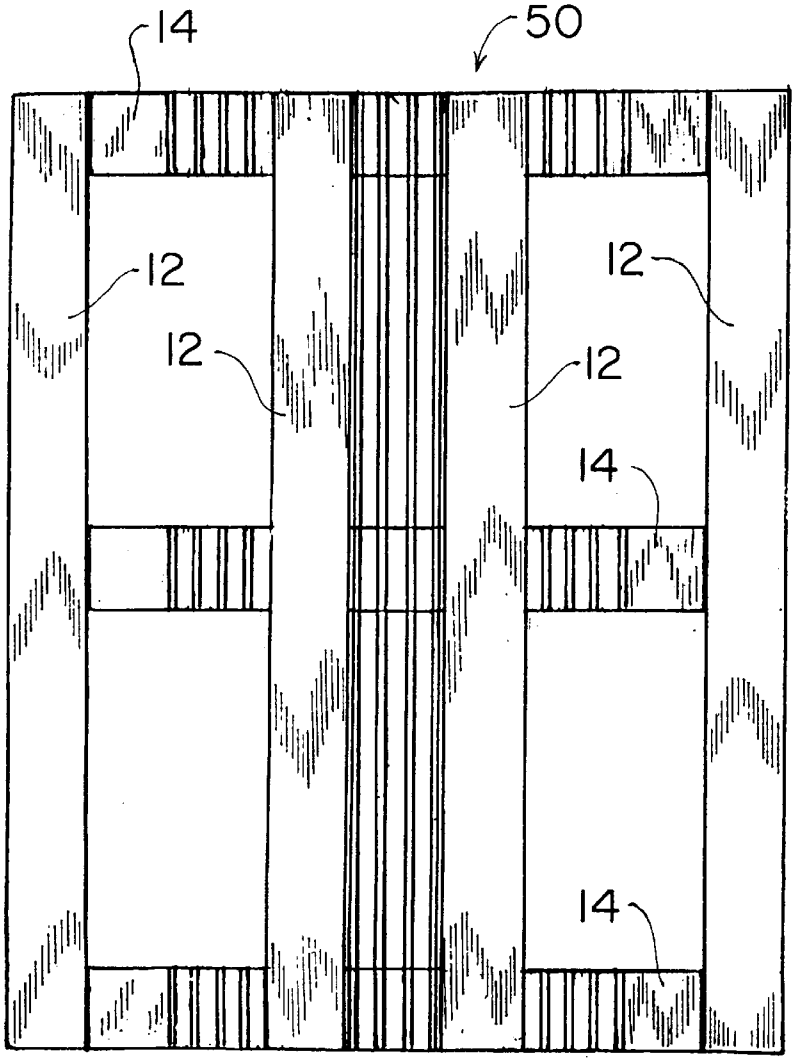
FIG. 13 is a top plan view of the pallet of FIG. 11.

Another embodiment 30 of the invention includes an additional component designed to provide continuous support to the underside of the pallet (or, as commonly stated in the art, to "box in" the pallet). This third component, shown in FIGS. 8 and 9, consists of a foot frame 32 that is placed between each pair of blocks 16 to add a bearing surface 34 aligned with the bottom surface of adjacent slats 12. Thus, as also seen in the bottom view of FIG. 10, the combination of the three bottom slats 12 and the two foot frames 32 forms a transverse bottom rail along each runner that complements the longitudinal rails provided by the bottom slats. This "boxed in" configuration is preferred for pallets that are likely to be placed on rollers or conveyors because of the additional structural integrity and sturdiness provided by the frames. In order to still allow lifting of the pallet with a forklift, the foot frames 32 retain an inner opening 36 (FIG. 9) for insertion of the prongs of a lifting fork. It is noted that the foot frames 32 may consist of separate components adapted for releasable attachment, by way of resilient latches or other equivalent fastening means, to the underside of the runners 32 or may be an integral part thereof. That is, an alternative runner embodiment could consist of the integral combination of the components 14 and 32.

As clearly illustrated in FIGS. 1, 2, 6, 8 and 9, the fastening ridges 18 of the slats 12 are separated by uniform spacings which correspond to the spacing between the clasping slots 20 adapted to receive the ridges within the top structural member of the runner 14. According to another aspect of this invention, each runner contains a series of slots 20 equally spaced along its length (the direction transverse to the longitudinal axis of the pallet), so that the slats 12 can be placed in alternative positions and additional slats can be used for greater structural strength in assembling a pallet. At the same time, because of the continuous nature of the longitudinal fastening ridges 18, multiple runners 14 can also be used at different points along the length of the slats 12, as required for a particular application.

Each end of the preferred embodiment of the runner 14 of the invention is shown with three double-sided slots 20 and a single-sided slot 38 (see FIG. 4) substantially where a top slat 12 would always be mounted for optimal configuration of most pallet. It is noted that the single-sided slot 38 functions in a manner equivalent to the double-sided slot 20 by engaging the single lip 22 through compression and resilient deformation of the end ridge 18 with the single edge 40 (FIG. 4) of the single-sided slot 38. A fourth double-sided slot 20 could obviously be used in equivalent manner instead of the single-sided slot 38 by shifting these clasping slots slightly away from the end toward the interior of the runner.

Figure 16:
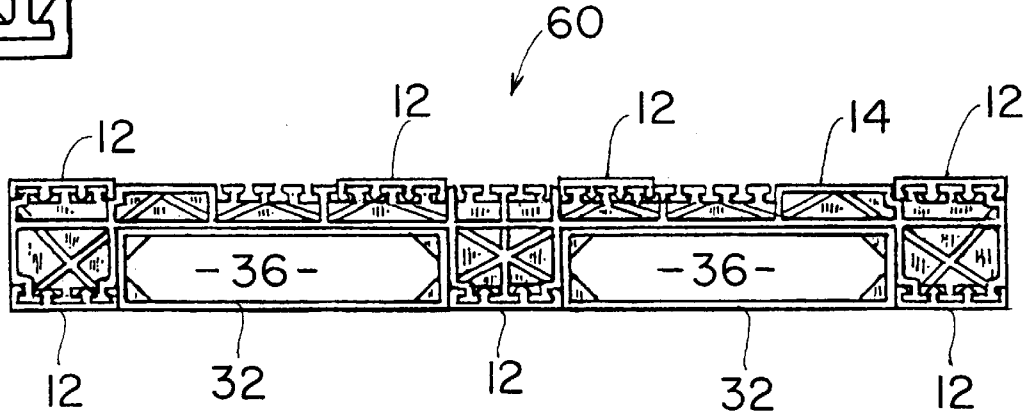
FIG. 16 is an elevational view of the front side of the pallet of FIG. 15.
Figure 15:
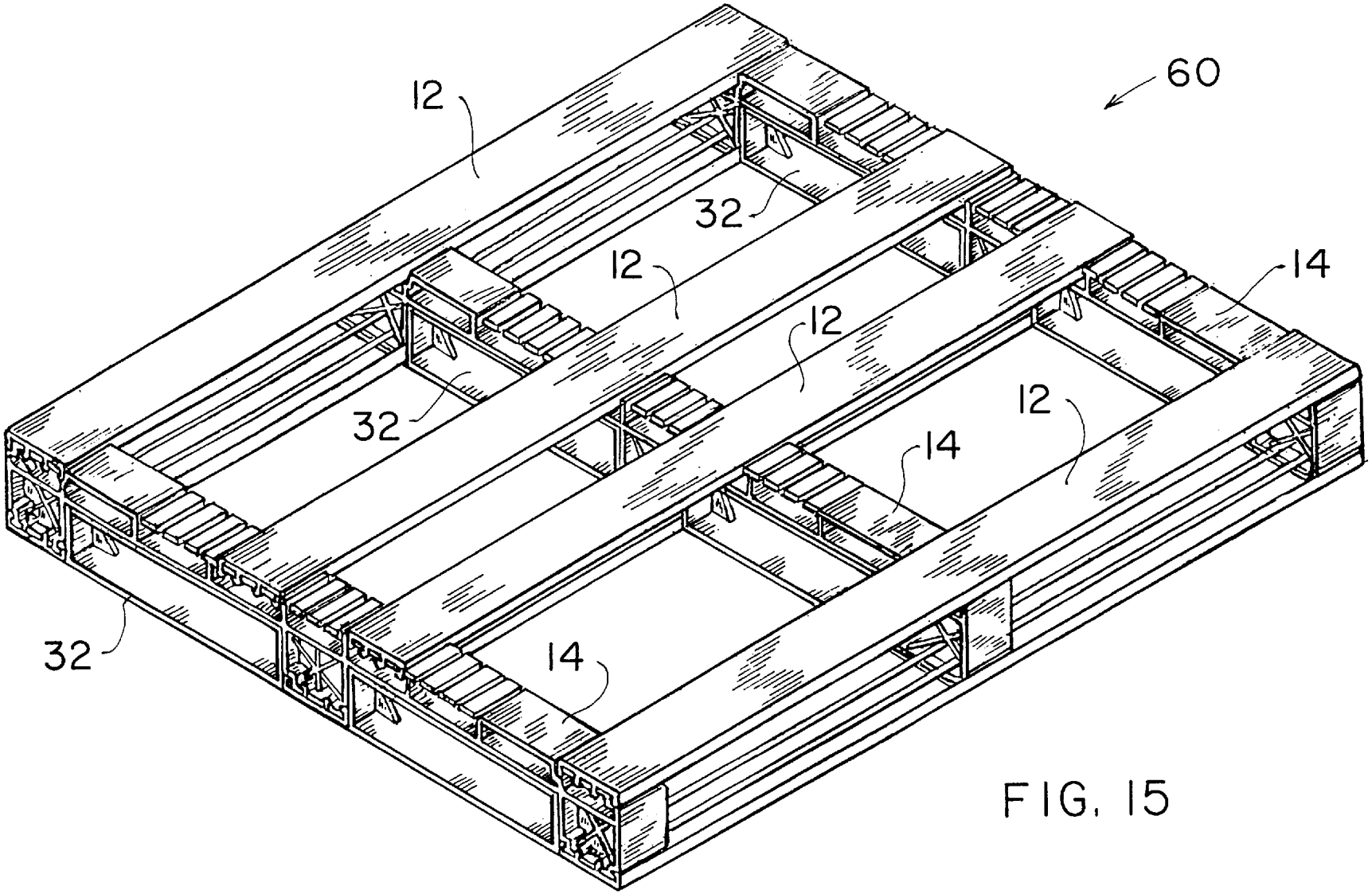
FIG. 15 is a perspective view of another embodiment of the pallet of FIG. 11 which further includes modular foot frames forming continuous transverse supports on the bottom side of the pallet.
Figure 17:
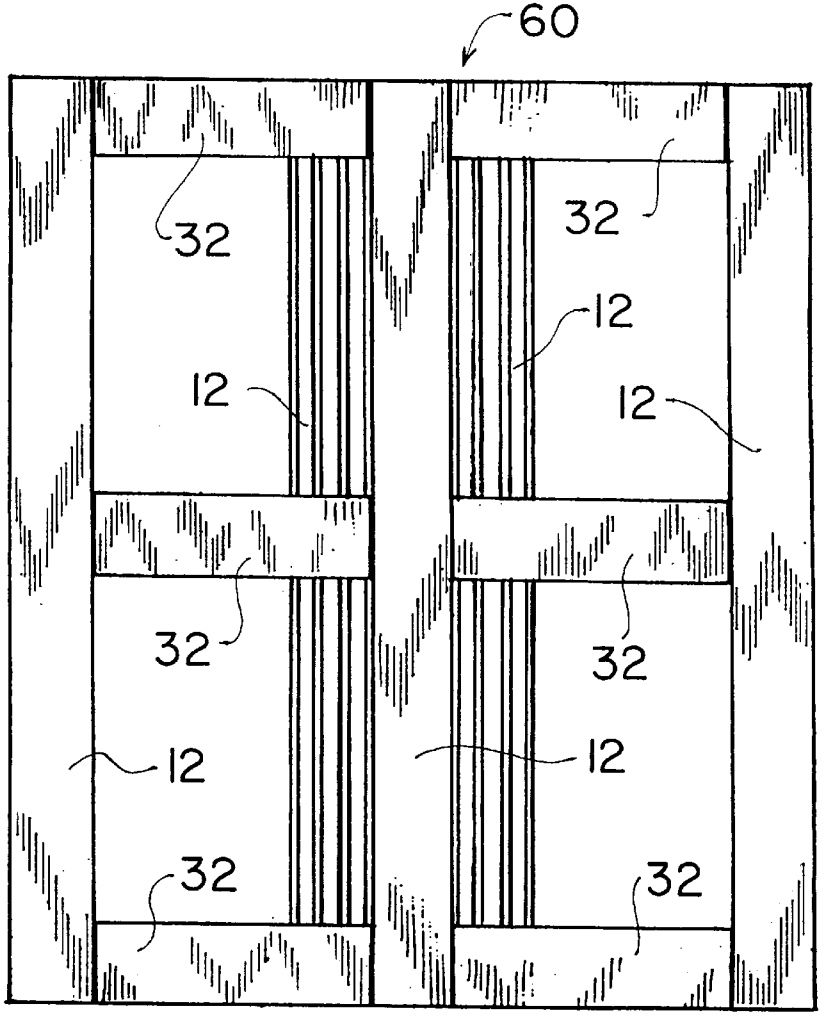
FIG. 17 is a bottom plan view of the pallet of FIG. 15, showing the continuous bottom rails formed by the addition of foot frames.
Figure 24:
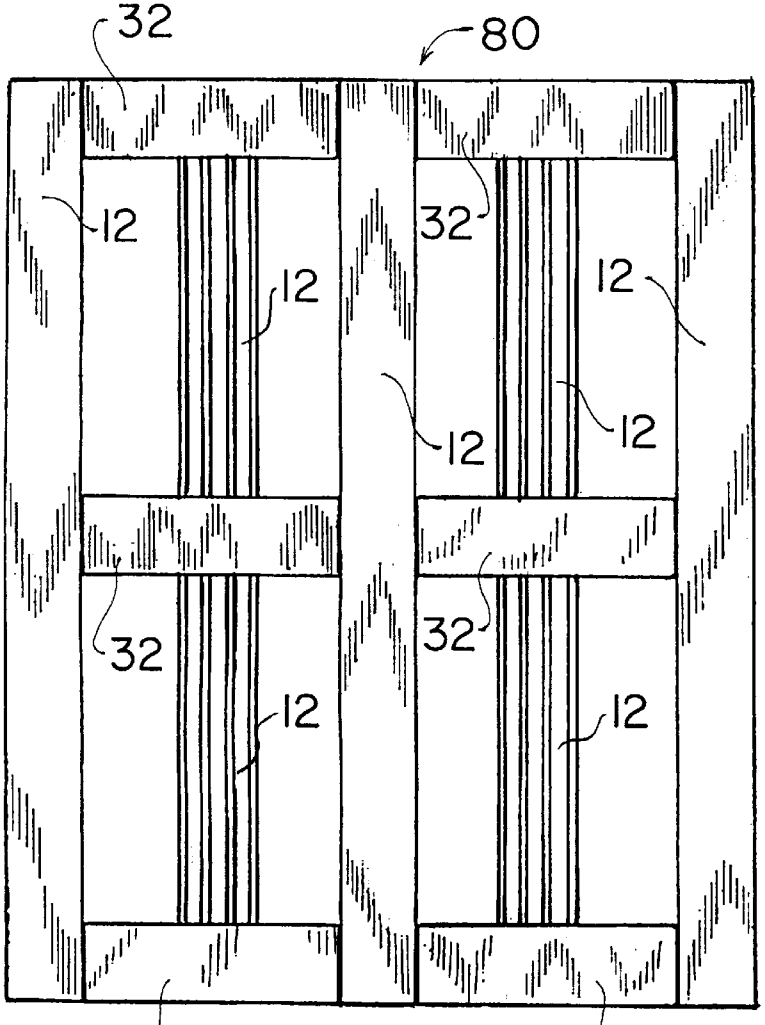
FIG. 24 is a bottom plan view of the pallet of FIG. 22, showing the continuous bottom rails formed by the addition of foot frames.
Figure 18:
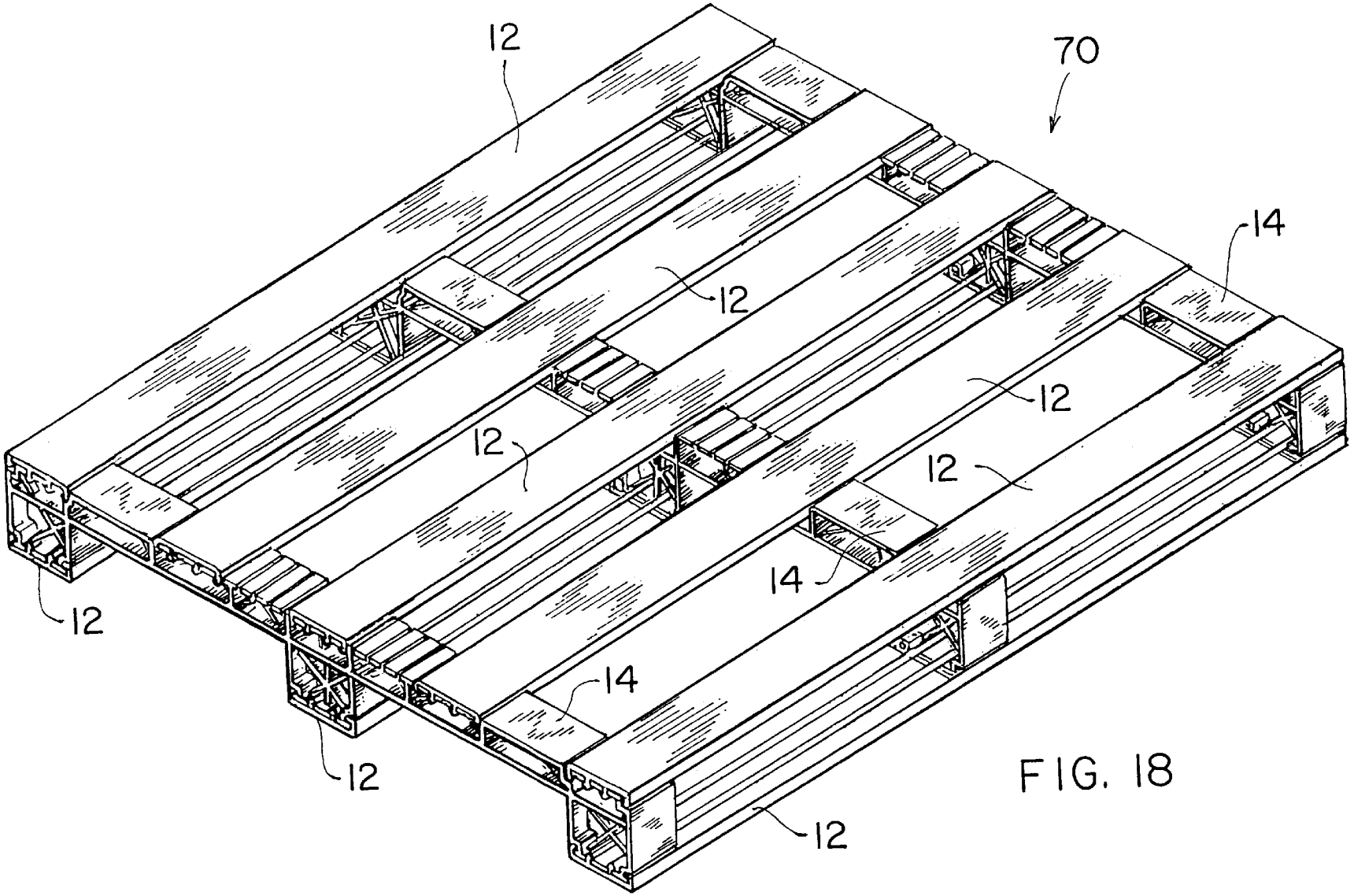
FIG. 18 is a perspective view of a five top-slat embodiment of a pallet according to the invention.
Figure 19:
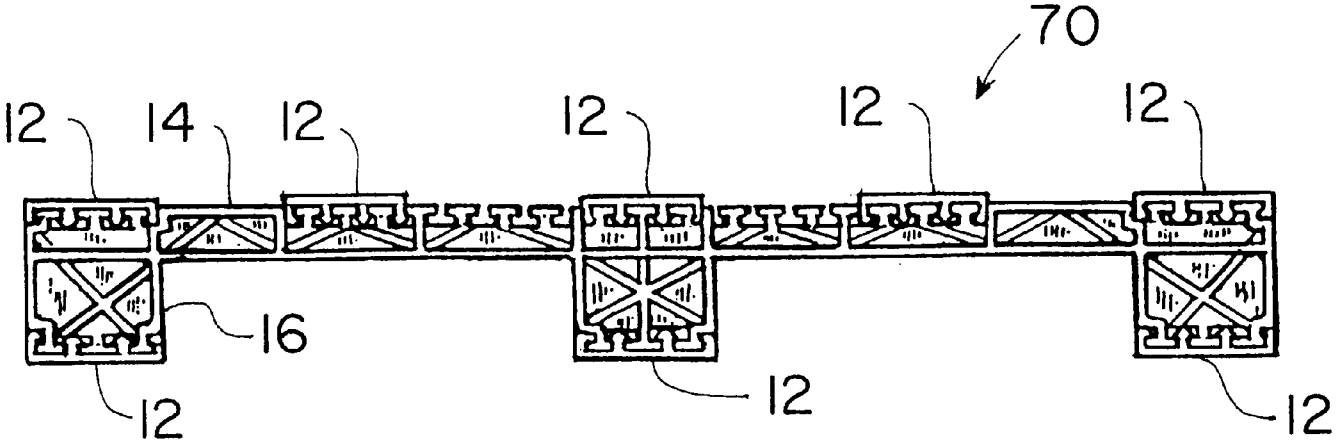
FIG. 19 is an elevational view of the front side of the pallet of FIG. 18.
Figure 23:
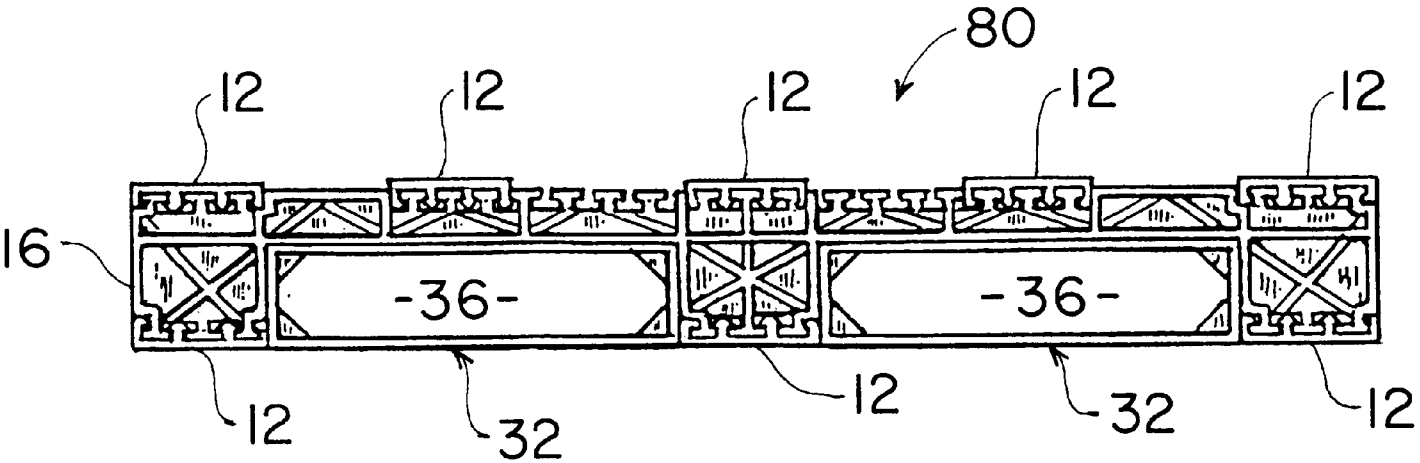
FIG. 23 is an elevational view of the front side of the pallet of FIG. 22.
Figure 20:
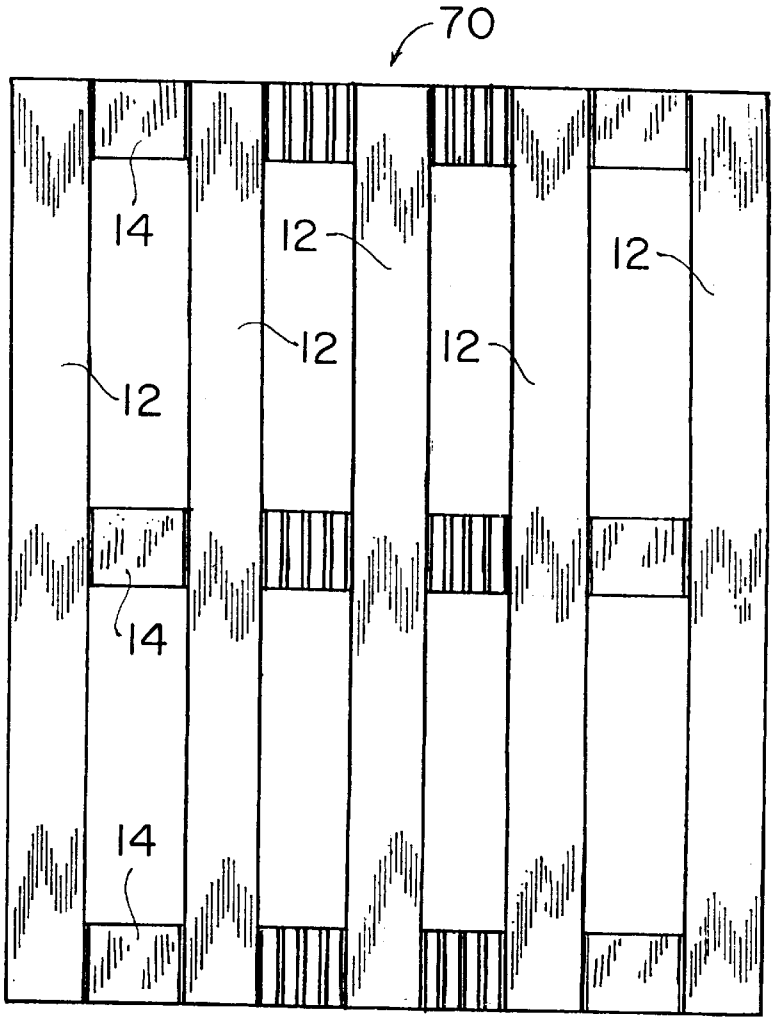
FIG. 20 is a top plan view of the pallet of FIG. 18.
Figure 21:
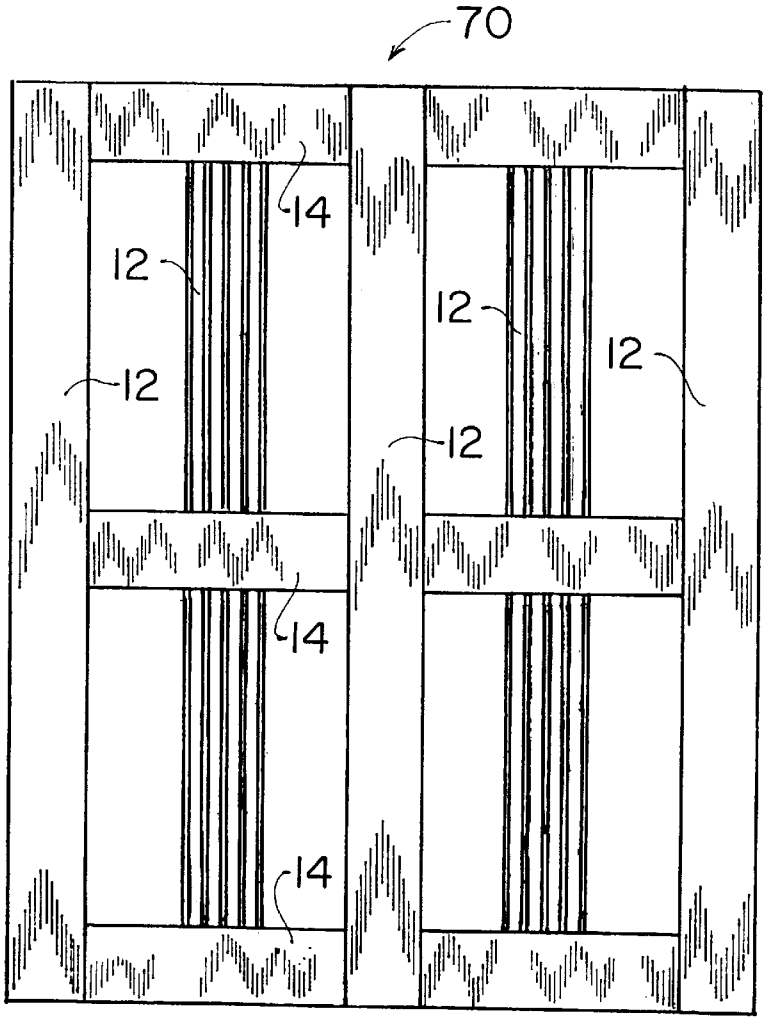
FIG. 21 is a bottom plan view of the pallet of FIG. 18.
Figure 22:
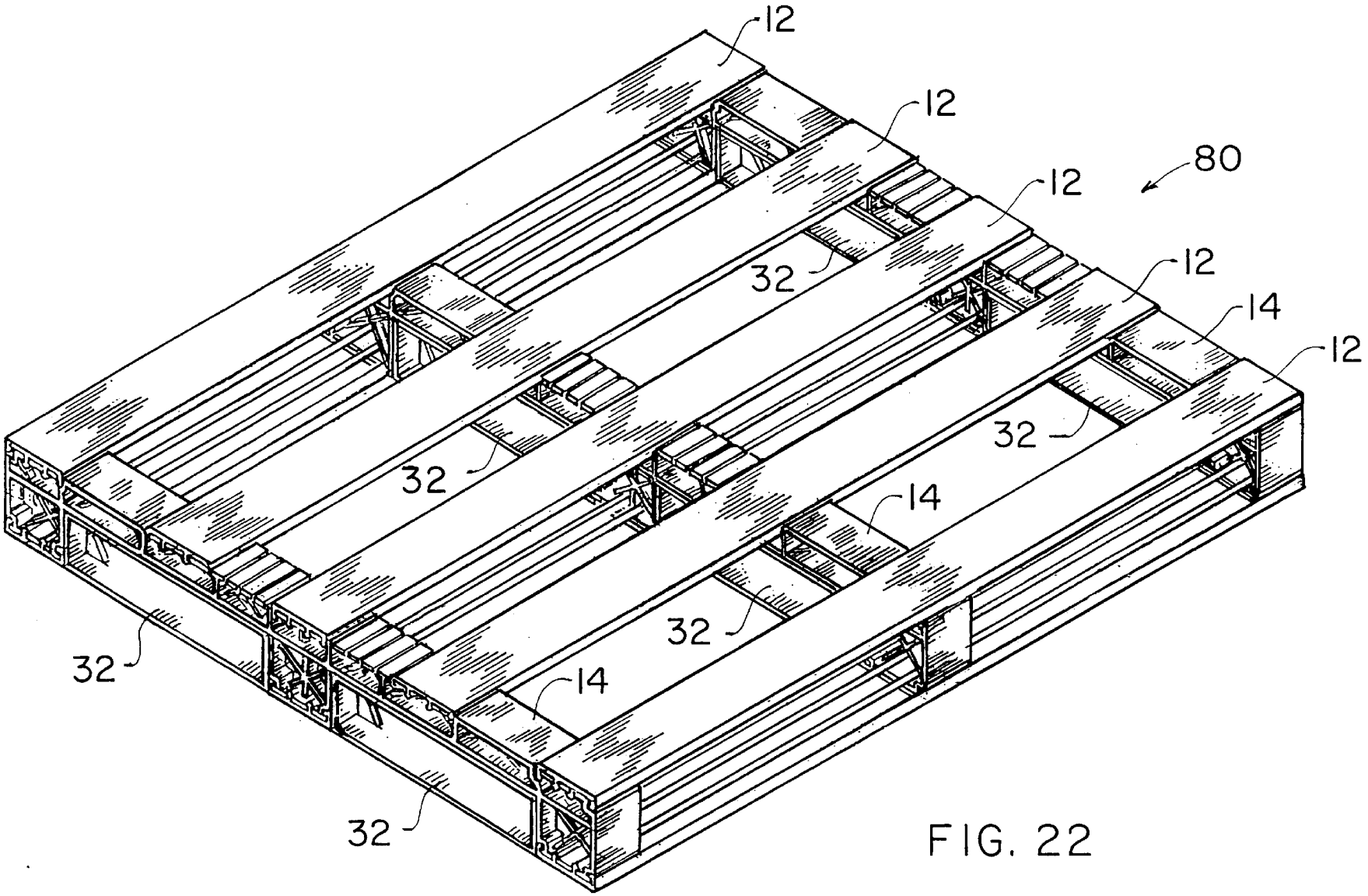
FIG. 22 is a perspective view of another embodiment of the pallet of FIG. 18 which further includes modular foot frames forming continuous transverse supports on the bottom side of the pallet.

FIGS. 11–14 illustrate a different embodiment of a pallet 50 having four top slats 12 mounted symmetrically with respect to the pallet's longitudinal axis. In all other respects, the pallet is the same as the three top-slat embodiment disclosed in FIGS. 1–7. The additional slat is added to provide greater strength and more support surface in case of a load consisting of items having a small base. The addition of foot frames 32 (or the equivalent use of runners including the frames) results in the pallet 60 shown in FIGS. 15–17. Yet sturdier embodiments 70 and 80 can be assembled in similar fashion by using five top slats 12 mounted on three or more runners 14. FIGS. 18–21 and 22–24 illustrate such five top-slat embodiments without and with foot frames, respectively.

It is clear from the illustrations that the modular pallet of the invention provides multiple alternative embodiments with only three basic components. The runners 14 shown in the examples have a set of clasping slots 20,38 for receiving a slat 12 at each end and a series of 18 uniformly spaced slots 20 along the central portion of the top structural member of the runner. Thus, multiple interior slats 12 can be positioned anywhere along this series of slots, giving a user the option of custom building the pallet as needed for a particular load. All pallets should have three bottom slats 12 mounted on clasping slots 20,38 at the bottom of each block 16. Although not shown in any example, more that three runners could also be used to strengthen the pallet, or only two at each longitudinal end if a very light load were supported. The modular nature and multiple connection points of the components of the invention afford great flexibility in customizing a pallet according to need.

After use in transporting a load, the pallets of the invention can be stacked for storage and/or shipment like conventional pallets, or they can be disassembled simply by pulling each component apart from the others. The various components can then be gathered in orderly fashion in a much smaller volume than the assembled pallets from which they derive. In the preferred embodiment of the invention, all components consist of extruded polystyrene or polyvinyl chloride (PVC), or mixtures thereof, which are all particularly suitable for this purpose because of their light weight, strength, rigidity and resilience. As easily understood by those skilled in the art, any rigid material with sufficient resilience to enable the implementation of the disclosed latching mechanisms would be suitable to practice the invention. Therefore, plastic materials are preferred because they normally have these properties.

In the preferred embodiment of the invention, it is contemplated that slats will be manufactured in a length of about 122 cm (48 inches), a width of about 10 cm (4 inches), and a thickness of about 1.1 cm (7/16 inches).

Runners will be about 101 cm (40 inches) long, 7.5 cm (3 inches) wide, and 14 cm (5.5 inches) tall, with a bottom clearance of about 9 cm (3.5 inches) between blocks. Each such slat and runner (including blocks, but without foot frames) manufactured with polystyrene or PVC would weigh less than about 0.45 kg (less than one pound) and about 1.35 kg (about three pounds), respectively. Thus, a five top-slat pallet with four runners would weigh about 9 kg (about 20 pounds) and a five top-slat pallet with five runners would weigh about 10.5 kg (about 23 pounds). These pallets, which correspond to the largest standard size, would be considerably lighter than comparable conventional wooden pallets, which could be expected to weigh approximately 27 to 36 kg (60 to 80 pounds).

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

I claim:

1. A modular pallet comprising the following combination of components:

a plurality of runners, each runner having a top member supported by at least two equally-spaced blocks of substantially equal size, said top member and said blocks including transverse clasping slots providing alternative fastening sites over the top member; and a plurality of slats, each slat including longitudinal fastening ridges adapted to mate in releasable connection with said clasping slots;

whereby the pallet is assembled by fastening a slat to each of the blocks and by fastening multiple slats only at some of the alternative fastening sites in the top members of the runners in orthogonal disposition therewith.

2. The pallet of claim 1, wherein each runner comprises three equally-spaced blocks.

3. The pallet of claim 1, wherein said plurality of runners consists of three runners.

4. The pallet of claim 2, wherein said plurality of runners consists of three runners.

5. The pallet of claim 1, wherein said multiple slats fastened at some of the alternative fastening sites in the top members of the runners consist of three slats.

6. The pallet of claim 4, wherein said multiple slats fastened at some of the alternative fastening sites in the top members of the runners consist of three slats.

7. The pallet of claim 1, wherein said multiple slats fastened at some of the alternative fastening sites in the top members of the runners consist of four slats.

8. The pallet of claim 4, wherein said multiple slats fastened at some of the alternative fastening sites in the top members of the runners consist of four slats.

9. The pallet of claim 1, wherein said multiple slats fastened at some of the alternative fastening sites in the top members of the runners consist of five slats.

10. The pallet of claim 4, wherein said multiple slats fastened at some of the alternative fastening sites in the top members of the runners consist of five slats.

11. The pallet of claim 1, wherein the pallet is made with a rigid resilient material.

12. The pallet of claim 11, wherein said rigid resilient material is selected from the group consisting of polystyrene, polyvinyl chloride, and mixtures thereof.

13. The pallet of claim 6, wherein the pallet is made of a resilient material selected from the group consisting of polystyrene, polyvinyl chloride, and mixtures thereof.

14. The pallet of claim 8, wherein the pallet is made of a resilient material selected from the group consisting of polystyrene, polyvinyl chloride, and mixtures thereof.

15. The pallet of claim 10, wherein the pallet is made of a resilient material selected from the group consisting of polystyrene, polyvinyl chloride, and mixtures thereof.

16. The pallet of claim 2, further comprising a foot frame between each pair of said equally-spaced blocks, said frame comprising a support surface aligned with the slats fastened to each of the blocks.

17. The pallet of claim 16, wherein the pallet is made of a resilient material selected from the group consisting of polystyrene, polyvinyl chloride, and mixtures thereof.

18. A kit for a modular pallet comprising the following combination of components:

a plurality of identical runners, each runner having a top member supported by at least two equally-spaced blocks, said top member and said blocks including multiple first components of a latching mechanism providing alternative fastening sites over the top member;

a plurality of identical slats, each slat including second components of the latching mechanism adapted to mate in releasable connection with said first components; and a plurality of identical foot frames adapted for attachment between each pair of said equally-spaced blocks, each of said foot frames comprising a support surface aligned with the slats fastened to each of the blocks after assembly of the pallet.

19. The kit of claim 18, wherein said first components of a latching mechanism consist of clasping slots and said second components consist of fastening ridges adapted to mate in releasable connection with said clasping slots.

20. The kit of claim 19, wherein said slats, runners and foot frames are made with a rigid resilient material selected from the group consisting of polystyrene, polyvinyl chloride, and mixtures thereof.

* * * * *